US007721799B2

(12) United States Patent
Baski

(10) Patent No.: US 7,721,799 B2
(45) Date of Patent: May 25, 2010

(54) FLOW CONTROL PACKER (FCP) AND AQUIFER STORAGE AND RECOVERY (ASR) SYSTEM

(75) Inventor: Henry A. Baski, Denver, CO (US)

(73) Assignee: Baski, Inc., Lakewood, CO (US)

( * ) Notice: Subject to any disclaimer, the term of this patent is extended or adjusted under 35 U.S.C. 154(b) by 321 days.

(21) Appl. No.: 11/868,473

(22) Filed: Oct. 6, 2007

(65) Prior Publication Data

US 2008/0179055 A1 Jul. 31, 2008

Related U.S. Application Data

(60) Provisional application No. 60/849,954, filed on Oct. 6, 2006.

(51) Int. Cl.
*E21B 23/00* (2006.01)
*E21B 33/12* (2006.01)

(52) U.S. Cl. ..... 166/147; 166/183; 166/101

(58) Field of Classification Search ..... 166/101, 166/183, 147; 138/93; 277/331, 338, 340, 277/605, 646
See application file for complete search history.

(56) References Cited

U.S. PATENT DOCUMENTS 3,529,667 A * 9/1970 Malone ..... 166/387
4,408,485 A * 10/1983 McGill ..... 73/152.38
4,455,027 A * 6/1984 Baski ..... 277/334
4,614,346 A * 9/1986 Ito ..... 277/334
4,892,144 A * 1/1990 Coone ..... 277/334
5,316,081 A 5/1994 Baski et al.
5,778,982 A 7/1998 Hauck et al.
6,073,906 A 6/2000 Wallace
6,158,506 A * 12/2000 Carisella ..... 166/187
6,273,195 B1 8/2001 Hauck et al.
6,338,466 B1 1/2002 Wallace et al.
6,615,926 B2 9/2003 Hester et al.
6,691,786 B2 2/2004 Patel
6,811,353 B2 11/2004 Madison
6,938,698 B2 9/2005 Coronado

OTHER PUBLICATIONS

Catalog 6, Baski, Inc., Manufacturer of Inflatable Packers, Flow Control Valves, Pitless Units and other products for investigating, controlling and producing the Earth's Fluids™, pp. 1-23, date unknown.

* cited by examiner

*Primary Examiner*—David J Bagnell
*Assistant Examiner*—Cathleen R Hutchins
(74) *Attorney, Agent, or Firm*—Stephen A. Gratton

(57) ABSTRACT

A flow control packer (FCP) includes a packer mandrel, and an inflatable element fixedly attached at each end to the mandrel. The inflatable element includes circumferential grooves and flow control grooves formed on an outside surface thereof configured to press against the inside diameter of a conduit to provide a flow resistant surface for controlling the flow rate of a fluid through the conduit. A system can include one or more flow control packers (FCP) configured to control fluid flow through different sections of the conduit.

25 Claims, 10 Drawing Sheets

FLOW CONTROL PACKER (FCP) AND AQUIFER STORAGE AND RECOVERY (ASR) SYSTEM

CROSS REFERENCE TO RELATED APPLICATION

This application claims priority from U.S. provisional application Ser. No. 60/849,954 filed Oct. 6, 2006.

BACKGROUND

A packer is an expandable plug configured to isolate sections of a conduit, such as a well casing, a borehole or a pipe. Packers can be used for performing various operations in the isolated sections of the conduit. For example, in a well casing or a bore hole, packers can be used to isolate different sections (i.e., zones) for hydrofracturing, grouting, sampling and monitoring. Packers can also be used to isolate different sections of a well casing or borehole for pumping fluids out of, or injecting fluids into the isolated sections.

One type of packer is known as an inflatable packer. Inflatable packers have been used in the oil and gas industry since the 1940's. Until recently, however, their use was restricted by prohibitive cost and limited availability. Now, several disciplines (e.g., ground water development, contamination studies, dewatering, geothermal, mining, coal bed methane, and geotechnical studies) use a wide selection of reasonably priced inflatable packers. The inflatable packer has significant advantages compared to other packer designs. These include a high expansion ratio, a minimal outside diameter combined with a large interior diameter opening, a long sealing section, which conforms to uneven sides in a conduit, and a high pressure rating.

The inflatable packer includes a mandrel made of tubing or pipe, having an inflatable element attached at one or both ends to an outside diameter thereof. Typically, the mandrel has threaded connections (e.g., NPT, API casing threads) at both ends. An inflation port allows gas, water or a solidifying liquid to be injected between the mandrel and the inflatable element. This expands the inflatable element against the inside diameter of the well or borehole to prevent fluids from flowing along the outside of the packer. However, since the mandrel also has an inside diameter, fluid can pass through the mandrel. Similarly, tubes, wire or other elements can be passed through the mandrel.

Recently, inflatable packers have been used to control fluid flow and pressure in a well or borehole. For example, U.S. Pat. No. 5,316,081 to Baski et al. and U.S. Pat. No. 6,273,195 to Hauck et al. disclose inflatable packers configured as flow and pressure control valves for wells.

One application for this type of inflatable packer is in aquifer and storage recovery (ASR). With aquifer and storage recovery (ASR) large volumes of treated water are injected and stored in aquifers during periods of the year when water and treatment facility capacity are available (e.g., winter). During periods of the year when water is in high demand (e.g., summer), water is pumped out of the aquifers. Both injection of water into an aquifer, and pumping of water out of the aquifer require flow and pressure regulation over a wide range of flow rates. In addition, it is advantageous for a flow control packer to provide flow control during both injection of water into the aquifer, and during pumping of water out of the aquifer.

Various embodiments of the flow control packer (FCP) to be further described can be used to control the flow and pressure of a fluid in either direction in a conduit, such as a well casing, a borehole, or a pipe. In addition, the flow control packer (FCP) can be used over a wide range of flow rates, pressures, and conduit sizes. Further, the flow control packer (FCP) can be used to construct various systems including aquifer and storage recovery (ASR) systems, and can be constructed to control flow rates for either injection into an aquifer or for pumping out of the aquifer.

However, the foregoing examples of the related art and limitations related therewith, are intended to be illustrative and not exclusive. Other limitations of the related art will become apparent to those of skill in the art upon a reading of the specification and a study of the drawings.

SUMMARY

A flow control packer (FCP) includes a packer mandrel, and an inflatable element fixedly attached at each end to the packer mandrel. The packer mandrel comprises an elongated tubular member having an inside diameter and an outside diameter. The inflatable element is fixedly attached at each end to the outside diameter of the packer mandrel using attachment members, such as crimp rings. The inflatable element is configured for inflation for engaging an inside diameter of a conduit, such as a well casing, a borehole or a pipe. In addition, an outside surface of the inflatable element includes spaced circumferential grooves which form flow control segments. The inflatable element also includes flow control grooves on the flow control segments, configured to press against the inside diameter of the conduit to provide flow paths between the inflatable element and the conduit. In addition, one or more of the flow control segments have no flow control grooves and function as shut off segments.

Depending on the inflation pressure of the inflatable element, the fluid can flow between the outside surface of the inflatable element and the inner surface of the conduit at a selected flow rate and pressure, or the flow can be completely shut off by the inflatable element. In addition, the size of the flow control grooves, and the stretch pressure of the inflatable element along the length thereof, can be varied to provide variable flow control along the length of the inflatable element as a function of inflation pressure.

In a first embodiment, the flow control packer (FCP) is configured to control fluid flow in either direction through the conduit. In the first embodiment, a center portion of the inflatable element has a lower stretch pressure than end portions thereof, and includes relatively larger flow control grooves. In a second embodiment, the flow control packer (FCP) is configured to control fluid flow in only one direction through the conduit. However, the second embodiment can be oriented in an opposing direction in the conduit to control flow in the opposite direction. In the second embodiment, one end of the inflatable element has a lower stretch pressure than an opposing end, and includes relatively larger flow control grooves.

A system can include one or more flow control packers (FCP) configured to control fluid flow through different sections of the conduit. In an illustrative embodiment, an aquifer and storage recovery (ASR) system includes an upper flow control packer (FSP) and a lower flow control packer (FSP) configured to control the flow of water from different water bearing zones of a water well.

BRIEF DESCRIPTION OF THE DRAWINGS

Exemplary embodiments are illustrated in the referenced figures of the drawings. It is intended that the embodiments and the figures disclosed herein are to be considered illustrative rather than limiting.

DETAILED DESCRIPTION

Figure 1:
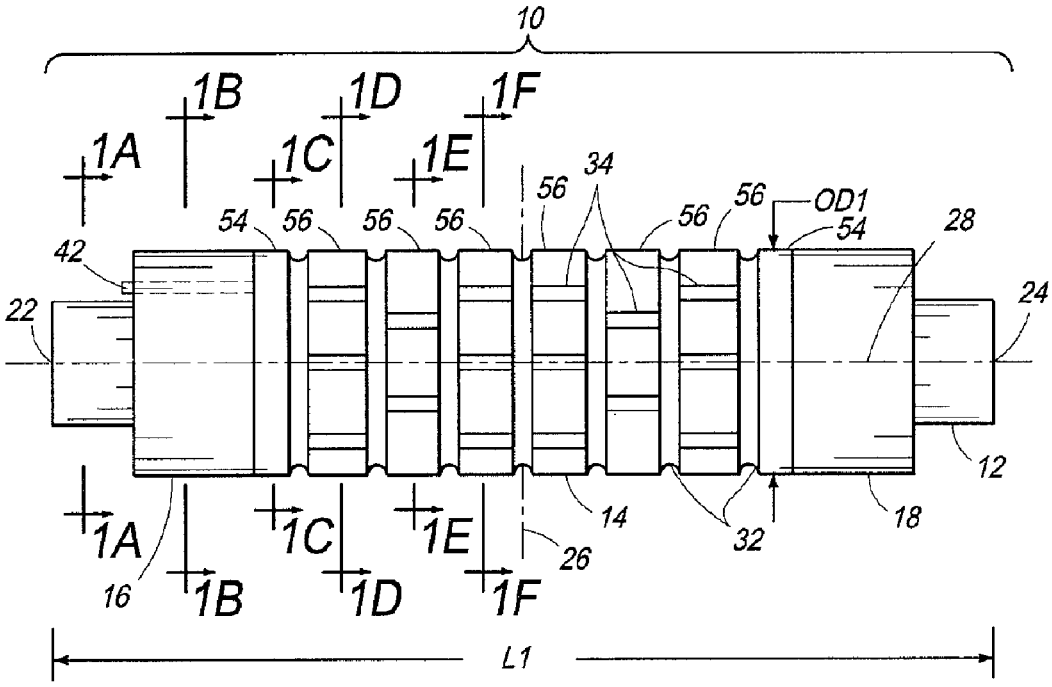
FIG. 1 is a schematic side elevation view of a flow control packer (FCP) in an uninflated condition.
Figure 2A:
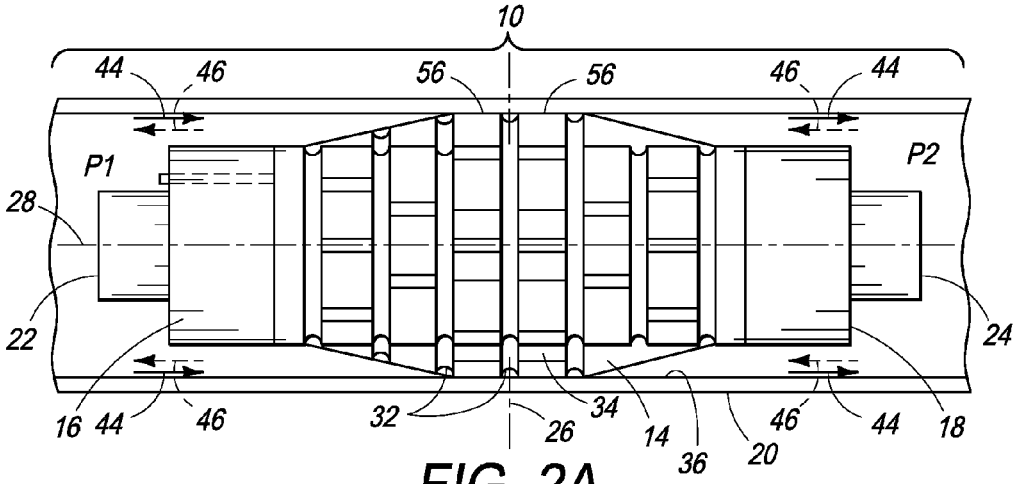
FIG. 2A is an enlarged schematic cross sectional view of the flow control packer (FCP) controlling fluid flow in a conduit at a first inflation pressure.
Figure 2B:
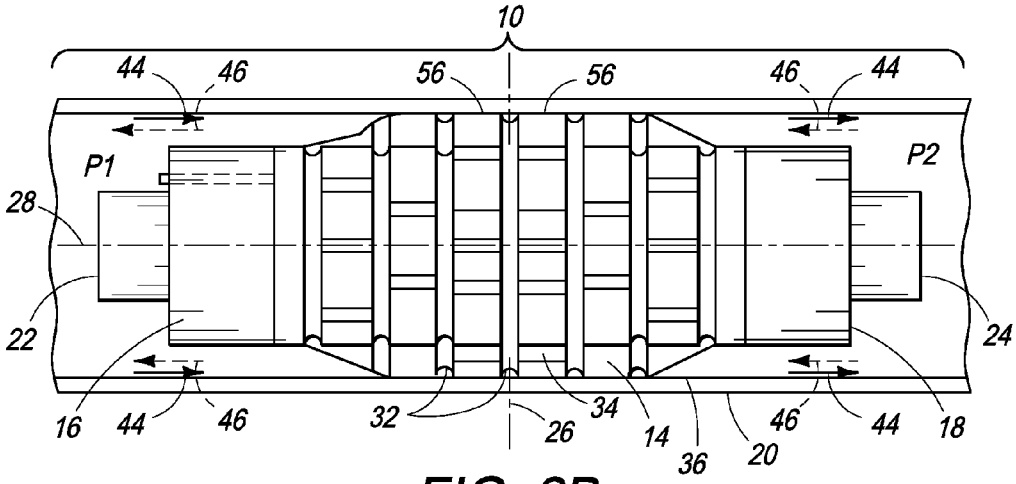
FIG. 2B is an enlarged schematic cross sectional view of the flow control packer (FCP) controlling fluid flow in the conduit at a second inflation pressure.
Figure 2C:
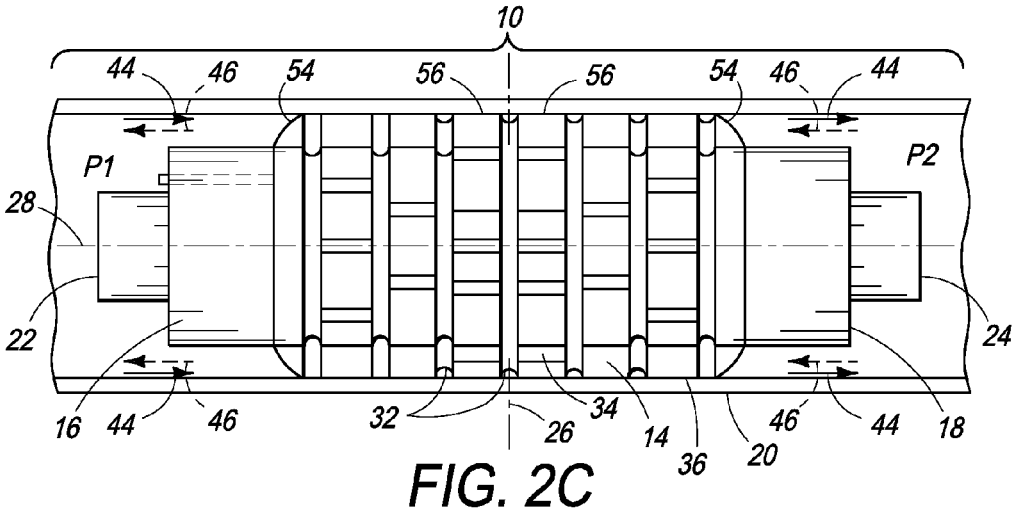
FIG. 2C is an enlarged schematic cross sectional view of the flow control packer (FCP) shutting off fluid flow in the conduit at a third inflation pressure.

Referring to FIG. 1, a flow control packer (FCP) 10 includes a packer mandrel 12, an inflatable element 14, and attachment members 16, 18 attaching the inflatable element 14 to the packer mandrel 12. In FIG. 1, the flow control packer (FCP) 10 is illustrated in an "uninflated" condition. In FIGS. 2A-2C, the flow control packer (FCP) 10 is illustrated in a conduit 20 (FIG. 2) in an "inflated" condition at different inflation pressures.

As will be further described, the flow control packer (FCP) 10 is configured to control fluid flow in either direction in the conduit 20 (FIG. 2A-2C), and to completely shut off fluid flow in the conduit 20 (FIG. 2A-2C). An alternate embodiment flow control packer (FCP) 10A (FIG. 3) to be hereinafter described, is configured to control fluid flow in only one direction in the conduit 20.

The flow control packer (FCP) 10 (FIG. 1) comprises a generally cylindrical shaped, elongated member having a length "L1" and an outside diameter "OD1". The length "L1" and the outside diameter "OD1" of the flow control packer (FCP) 10 can be selected as required. In addition, the outside diameter "OD1" of the flow control packer (FCP) 10 will vary depending on the inflation of the inflatable element 14. However, the outside diameter OD1 in the uninflated condition must be less than an inside diameter of the conduit 20 (FIGS. 2A-2C) to allow placement in the conduit 20. The flow control packer (FCP) 10 also includes a first end 22, a second end 24, a medial axis 26 centered between the first end 22 and the second end 24, and a longitudinal axis 20.

A representative value for the length "L1" of flow control packer (FCP) 10 can be from 3 feet to 50 feet. A representative value for the outside diameter "OD1" of flow control packer (FCP) 10 can be from 3 inches to 36 inches.

Figure 1A:
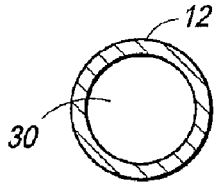
FIG. 1A is an enlarged schematic cross sectional view of the flow control packer (FCP) taken along section line 1A-1A of FIG. 1.

The packer mandrel 12 (FIG. 1) comprises an elongated hollow tubular conduit which extends along the entire length (L1) of the flow control packer (FCP) 10. The packer mandrel 12 can comprise mating tube or pipe segments that are welded, or otherwise attached, to form a unitary structure. In addition, the packer mandrel 12 can be made of a suitable metal, such as steel, stainless steel, iron or brass. As shown in FIG. 1A, the packer mandrel 12, and has an inside diameter and an outside diameter, which can vary in size on different portions thereof along the length of the flow control packer (FCP) 10. As also shown in FIG. 1A, the inside diameter of the packer mandrel 12 forms a center conduit 30 for the flow control packer (FCP) 10.

The packer mandrel 12 (FIG. 1) can also include pipe threads (not shown) proximate to the first end 22 and to the second end 24 of the flow control packer (FCP) 10, which allow the flow control packer (FCP) 10 to be attached to other elements (e.g., pipes, tubes, pumps, etc.) in a flow control system. Depending on the application, the pipe threads can comprise female pipe threads or male pipe threads with either an NPT or an API thread form configuration.

Figure 1B:
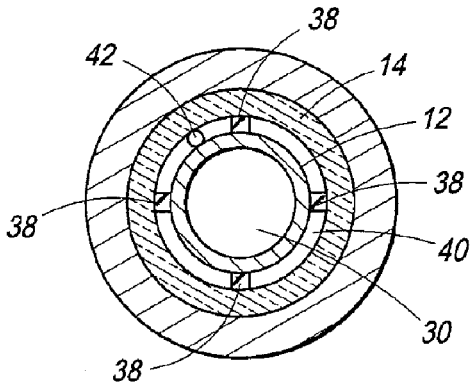
FIG. 1B is an enlarged schematic cross sectional view of the flow control packer (FCP) taken along section line 1B-1B of FIG. 1.
Figure 1C:
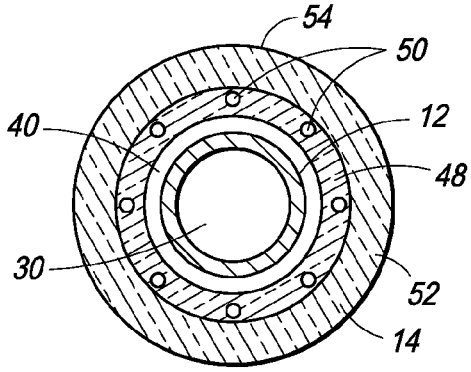
FIG. 1C is an enlarged schematic cross sectional view of the flow control packer (FCP) taken along section line 1C-1C of FIG. 1.

As shown in FIG. 1C, the inflatable element 14 comprises multiple layers of a resilient elastomeric materials that are vulcanized to form a unitary structure. For example, the inflatable element 14 (FIG. 1C) can comprise multiple layers of an elastomeric base material 48 (FIG. 1C), such as rubber, reinforced with a matrix of reinforcing strands 50 (FIG. 1C), such as polyester, nylon, rayon or steel cords. In addition, as will be further explained, the inflatable element 14 (FIG. 1C) includes a solid elastomeric outer layer 52 (FIG. 1C) having a selected thickness and durometer. As will also be further explained, the inflatable element 14 (FIG. 1C) can be constructed to have a lower stretch pressure near the medial axis 26 relative to the stretch pressure near the ends 22, 24 of the flow control packer (FCP) 10. This configuration can be achieved by varying the material or the orientation of the strands 50 (e.g., helical build angle), the number of plys of material, or the durometer of the elastomeric base material 48. U.S. Pat. No. 5,778,982 to Hauck et al., which is incorporated herein by reference, further describes the construction of inflatable elements for fixed head inflatable packers to achieve a desired stretch pressure and expansion ratio.

As shown in FIG. 1B, the packer mandrel 12 includes a plurality of circumferentially spaced ribs 38 that space the inflatable element 14 from the outside diameter of the packer mandrel 12. In addition, the ribs 38 form an annular space 40 between the packer mandrel 12 and the inflatable element 14. The annular space 40 is in flow communication with an inflation port 42, which permits a compressed fluid (gas or liquid) to be injected into the annular space 40 at a selected pressure for inflating the inflatable element 14. The attachment members 16, 18 which attach the inflatable element 14 to the packer mandrel 12 can comprise crimp rings, similar to those used for attaching fittings to hydraulic hoses. The attachment members 16, 18 are also configured to fixedly attach the inflatable element 14 to the packer mandrel 12, while allowing flow communication between the inflation port 42 and the annulus 40 (FIG. 1B). U.S. Pat. No. 5,778,982 to Hauck et al., further describes suitable structure for forming the attachment members 16, 18 for fixed head inflatable packers.

The inflatable element 14 (FIG. 1) also includes a plurality of circumferential grooves 32, and a plurality of parallel, spaced flow control grooves 34 formed in the outer layer 52 (FIG. 1C) on an outside surface thereof. With the inflatable element 14 in an inflated condition pressed against an inside diameter 36 of the conduit 20 (FIGS. 2A-2C), the circumferential grooves 32, and the flow control grooves 34 provide flow channels for fluid flow between the inflatable element 14 and the inside diameter 36 of the conduit 20.

The circumferential grooves 32 (FIG. 1) can comprise continuous, uniformly sized and spaced hemispherically shaped grooves formed on the outside circumferential surface of the inflatable element 14. Depending on the length L1 of the flow control packer (FCP) 10, there can be any selected number of circumferential grooves 32 (e.g., 5 to 50) which divide the inflatable element into a plurality of separate flow control segments 56 containing flow control grooves 32. In addition, the circumferential grooves 32 can have a selected depth (e.g., several millimeters or more), a selected width (several millimeters to a centimeter or more), and a selected spacing from one another (e.g., one to several centimeters or more). The thickness and durometer of the outer layer 52 (FIG. 1C) of the inflatable element 14 can be selected to allow the circumferential grooves 32, and the flow control grooves 34 as well, to be easily machined using a lathe and a suitable tool, such as heated knife. For example, heated knifes are commercially available from Ideal Heated Knives of New Hudson, Mich. For forming by heated knife, a representative durometer for the outer layer 52 (FIG. 1C) of the inflatable element 14 can be from 60 to 80 on the Shore A scale.

As with the circumferential grooves 32 (FIG. 1), the flow control grooves 34 (FIG. 1) are also formed in the outer layer 52 (FIG. 1C) and on the outside circumferential surface of the inflatable element 14. However, the flow control grooves 34 are formed between the circumferential grooves 32 in the flow control segments 56 generally parallel to the longitudinal axis 28 of the flow control packer (FCP) 10. In addition, the flow control grooves 34 have a depth D (FIGS. 1D-1F) that varies along the length L1 of the flow control packer (FCP) 10. Also, the flow control grooves 34 can have symmetrical patterns on either side of the medial axis 26 (FIG. 1), and staggered or offset patterns as the ends of the inflatable element 14 are approached. As shown in FIG. 1C, there are no flow control grooves 34 in a shut off segment 54 of the inflatable element 14 near the first end 22 of the flow control packer (FCP) 10. As the flow control grooves 34 are formed in a pattern that is symmetrical on either side of the medial axis 26 (FIG. 1), there are also no flow control grooves 34 in a shut off segment 54 (FIG. 1) near the second end 24 of the flow control packer (FCP) 10. As will be further explained, since the shut off segments 54 of the inflatable element 14 have no flow control grooves 34, in a fully inflated condition of the inflatable element 14 the ends thereof function to completely shut off flow through the conduit 20 (FIG. 2A-2C) in either direction.

Figure 1D:
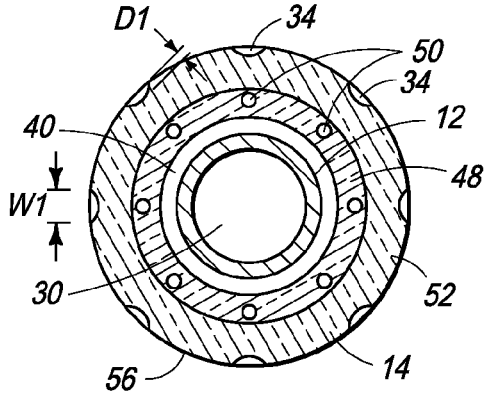
FIG. 1D is an enlarged schematic cross sectional view of the flow control packer (FCP) taken along section line 1D-1D of FIG. 1.
Figure 1E:
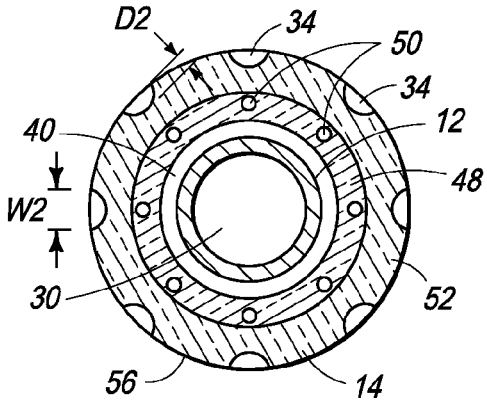
FIG. 1E is an enlarged schematic cross sectional view of the flow control packer (FCP) taken along section line 1E-1E of FIG. 1.
Figure 1F:
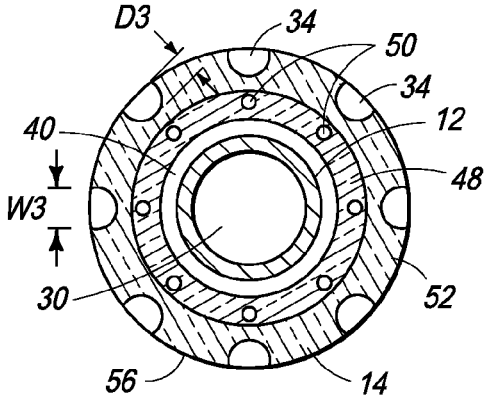
FIG. 1F is an enlarged schematic cross sectional view of the flow control packer (FCP) taken along section line 1F-1F of FIG. 1.

As also shown in FIGS. 1D-1F, the depth and width (i.e., the size) of the flow control grooves 34 increases as the medial axis 26 (FIG. 1) of the flow control packer (FCP) 10 is approached. As such, the flow control grooves 34 have a relatively shallow depth D1 (FIG. 1D) and small width W1 (FIG. 1D) near the ends of the inflatable element 14, an intermediate depth D2 (FIG. 1E) and width W2 (FIG. 1E) on either side between the ends and the medial axis 26 (FIG. 1), and a relatively large depth D3 (FIG. 1F) and width W3 (FIG. 1F), near the medial axis 26 (FIG. 1) of the flow control packer (FCP) 10. The depths D1-D3 and widths W1-W3 of the flow control grooves 34 can be selected as required, with from 10 mm to 3 cm being representative. In addition, the depth D3 (FIG. 1F) and width W3 (FIG. 1F) near the medial axis 26 (FIG. 1) can be from 1.5 to several times greater than the depth D1 (FIG. 1D) and width W1 (FIG. 1D) near the ends of the inflatable element 14. The flow control grooves 34 near the medial axis 26 (FIG. 1) are thus able to transmit a higher fluid flow. On the other hand, the flow control grooves 34 near the ends of the inflatable element 14 transmit less fluid flow and produce more frictional head loss in the fluid flow.

Referring to FIGS. 2A-2C, the operation of the flow control packer (FCP) 10 is illustrated. The flow control packer (FCP) 10 can be placed in the conduit 20 to control fluid flow in either direction in the conduit 20. In FIG. 2A, an upstream end of the conduit 20 has a fluid pressure P1, and a downstream end of the conduit 20 has a fluid pressure P2. In this case P1 is greater than P2 (P1>P2). In addition, fluid flow through the conduit 20 is illustrated by solid fluid flow arrows 44. However, the flow control packer (FCP) 10 can be used to control fluid flow in an opposite direction in the conduit 20, such that dotted flow control arrows 46 illustrate the case where P2 is greater than P1 (P2>P1). In down hole applications, such as where the conduit 20 comprises a well casing or a borehole, the flow control packer (FCP) 10 can be utilized to inject fluid in a downhole direction, and alternately to pump fluids in an uphole direction as well.

In FIG. 2A, the inflatable element 14 is inflated with an inflation pressure Pi having a value selected such that only flow control segments 56 of the inflatable element 14 proximate to the medial axis 26 of the flow control packer (FCP) 10, press against the inside diameter 36 of the conduit 20. In this case, the inflation pressure Pi can be selected to overcome the stretch pressure Ps of the inflatable element 14 near the medial axis 26, and the pressure P1 in the conduit as well. (Pi>Ps+P1). In addition, the inflation pressure Pi can be selected to achieve a selected downstream pressure P2, and a desired flow rate through the flow control channels 34 as well. To insure that the inflatable element 14 only inflates near the medial axis 26, the inflatable element 14 can be constructed with a lower stretch pressure near it's center relative to the ends thereof. Stated differently, the flow control segments 56 near the center of the inflatable element 14 have a lower stretch pressure than the flow control segments 56 near the ends of the inflatable element 14.

In FIG. 2B, the inflatable element 14 is inflated with an inflation pressure Pi having a value selected such that more flow control segments 56 of the inflatable element 14 are in contact with the inside diameter 36 of the conduit 20. This requires a higher inflation pressure Pi relative to the condition shown in FIG. 2A. In addition, as the flow control grooves 34 decrease in size in a direction away from the medial axis 26, the flow rate through the conduit 20 is less than the flow rate relative to the condition shown in FIG. 2A. The reduced flow rate also occurs due to higher flow restrictions and higher frictional head loss which are a function of the size of the flow control grooves. In the conduit 20 (FIGS. 2A-2C), the total head Th is equal to the velocity head Vh plus the pressure head Ph (Th=Vh+Ph). As the frictional losses increase with the smaller size of the flow control grooves 34, the velocity head Vh, the pressure head Ph, and the total head Th decrease. By way of illustration and not limitation, the flow velocities in FIGS. 2A and 2B can be optimized to achieve a flow velocity through the flow control grooves 34 of from about 1 foot/second to 10 feet/second.

In FIG. 2C, the inflatable element 14 is inflated with an inflation pressure Pi having a value selected such that almost all of the inflatable element 14 is in contract with the inside diameter 36 of the conduit 20. This requires a higher inflation pressure Pi relative to the condition shown in FIG. 2A or 2B. In addition, the flow rate through the conduit 20 can be effectively shut off as the inflatable element 14 has no flow control grooves 34 on the shut off segments 54. The flow control packer (FCP) 10 can thus be operated to control the flow rate, or to shut off the flow rate through the conduit 20, as a function of the inflation pressure Pi of the inflatable element 14.

Figure 3:
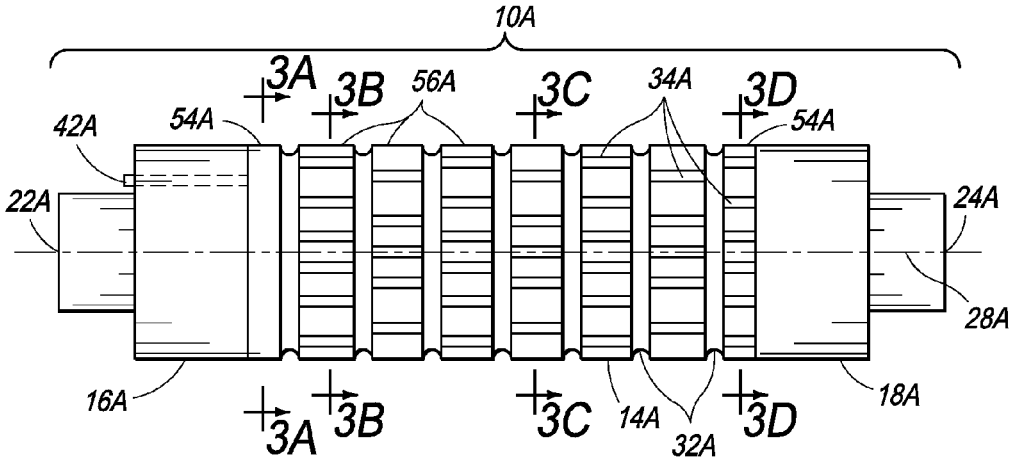
FIG. 3 is a schematic side elevation view of an alternate embodiment flow control packer (FCP) in an uninflated condition.
Figure 4A:
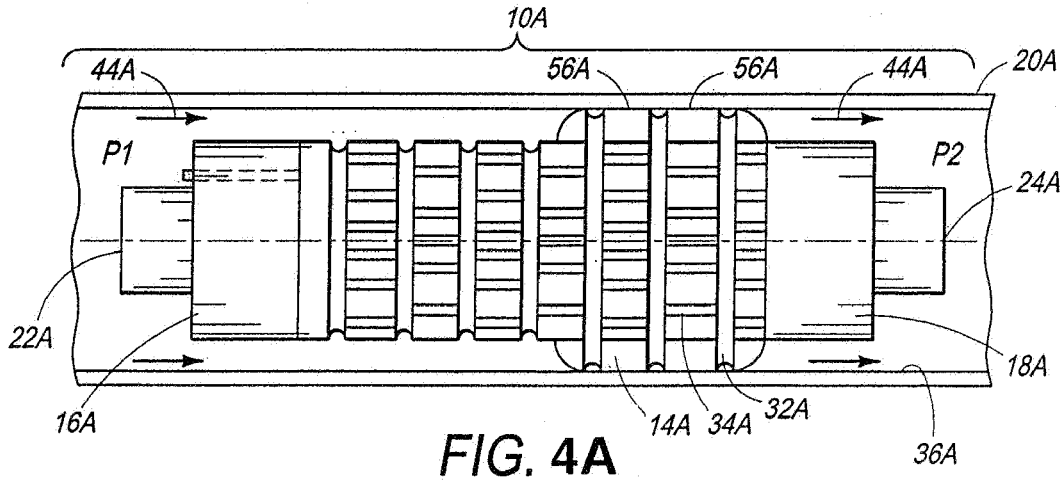
FIG. 4A is an enlarged schematic cross sectional view of the alternate embodiment flow control packer (FCP) controlling fluid flow in a conduit at a first inflation pressure.

Referring to FIG. 3, an alternate embodiment flow control packer (FCP) 10A is illustrated. The flow control packer (FCP) 10A is substantially similar to the flow control packer (FCP) 10 (FIG. 1), but is configured to control fluid flow in a conduit 20A (FIG. 4A) in only one direction. In down hole applications, either injection or pumping can be controlled. In addition, the flow direction is dependent on the orientation of the flow control packer (FCP) 10A in the conduit 20A (FIG. 4A).

The flow control packer (FCP) 10A (FIG. 3) includes a packer mandrel 12A, an inflatable element 14A and attachment members 16A, 18A. The packer mandrel 12A and the attachment members 16A, 18A are constructed substantially as previously described for packer mandrel 12 (FIG. 1) and attachment members 16, 18 (FIG. 1). However, as will be further explained, the inflatable element 14A is constructed differently than the inflatable element 14 (FIG. 1). As the flow control packer (FCP) 10A (FIG. 3) is orientation dependent, a first end 22A thereof is termed a "shut off" end, and a second end 24A thereof is termed a "flow control end".

As previously described, the flow control packer (FCP) 10A (FIG. 3) includes a longitudinal axis 28A. In addition, the packer mandrel 12A (FIG. 3) includes a center conduit 30A (FIG. 3A), and ribs (not shown) which form an annular space 40A (FIG. 3A) in flow communication with an inflation port 42A (FIG. 3A) for inflating the inflatable element 14A.

The inflatable element 14A (FIG. 3) includes circumferential grooves 32A and flow control grooves 34A, which are constructed substantially as previously described for the circumferential grooves 32 (FIG. 1) and the flow control grooves 34 (FIG. 1). However, rather than being on the medial axis 26 (FIG. 1) as with the flow control packer 10 (FIG. 1), the largest flow control grooves 34A (FIG. 3) are formed in flow control segments 56A near the second end 24A (flow control end) of the flow control packer (FCP) 10A. In addition, the smallest flow control grooves 34A, are formed in flow control segments 56A near the first end 22A (shut off end) of the flow control packer (FCP) 10A. Further, a shut off segment 54A of the inflatable element 14A has no flow control grooves 34A.

Figure 3A:
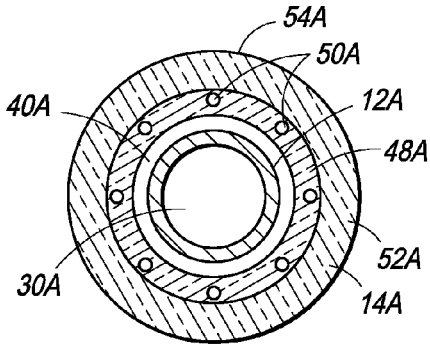
FIG. 3A is an enlarged schematic cross sectional view of the alternate embodiment flow control packer (FCP) taken along section line 3A-3A of FIG. 3.
Figure 3B:
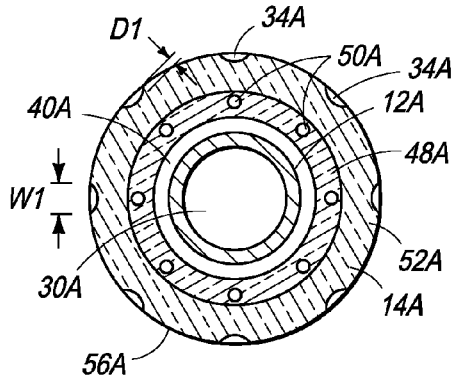
FIG. 3B is an enlarged schematic cross sectional view of the alternate embodiment flow control packer (FCP) taken along section line 3B-3B of FIG. 3.
Figure 3C:
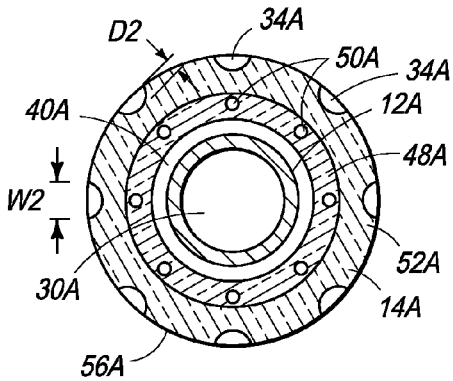
FIG. 3C is an enlarged schematic cross sectional view of the alternate embodiment flow control packer (FCP) taken along section line 3C-3C of FIG. 3.
Figure 3D:
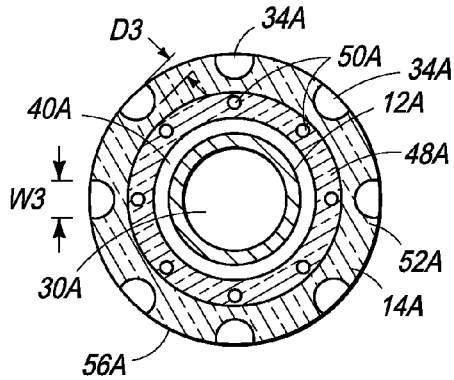
FIG. 3D is an enlarged schematic cross sectional view of the alternate embodiment flow control packer (FCP) taken along section line 3D-3D of FIG. 3.

FIGS. 3A-3D illustrate the configuration of the flow control grooves 34A of the flow control packer (FCP) 10A. As shown in FIG. 3A, there are no flow control grooves in the shut off segment 54A near the first end 22A (shut off end) of the flow control packer (FCP) 10A. As shown in FIG. 3B-3D, the largest flow control grooves 34A are formed in flow control segments 56A near the second end 24A (flow control end) of the flow control packer (FCP) 10A, the smallest flow control grooves 34A are formed in flow control segments 56A near the first end 22A (shut off end), and the flow control grooves 34A become progressively smaller from the second end 24A (flow control end) to the first end 22A (shut off end).

The inflatable element 14A (FIG. 3) of the flow control packer (FCP) 10A (FIG. 3) also includes multiple layers including an elastomeric base material 48A (FIG. 3A) reinforced with strands 50A, and an outer layer 52A wherein the circumferential grooves 32A and flow control grooves 34A are formed. The inflatable element 14A (FIG. 3) is also constructed such that the stretch pressure decreases in a direction from the second end 24A (flow control end) to the first end 22A (shut off end). This configuration can be achieved by varying the material or the orientation of the strands 50A (e.g., helical build angle), the number of plys of material, or the durometer of the elastomeric base material 48A. Previously incorporated U.S. Pat. No. 5,778,982 to Hauck et al., further describes the construction of inflatable elements for fixed head inflatable packers to achieve a desired stretch pressure and expansion ratio.

Figure 4B:
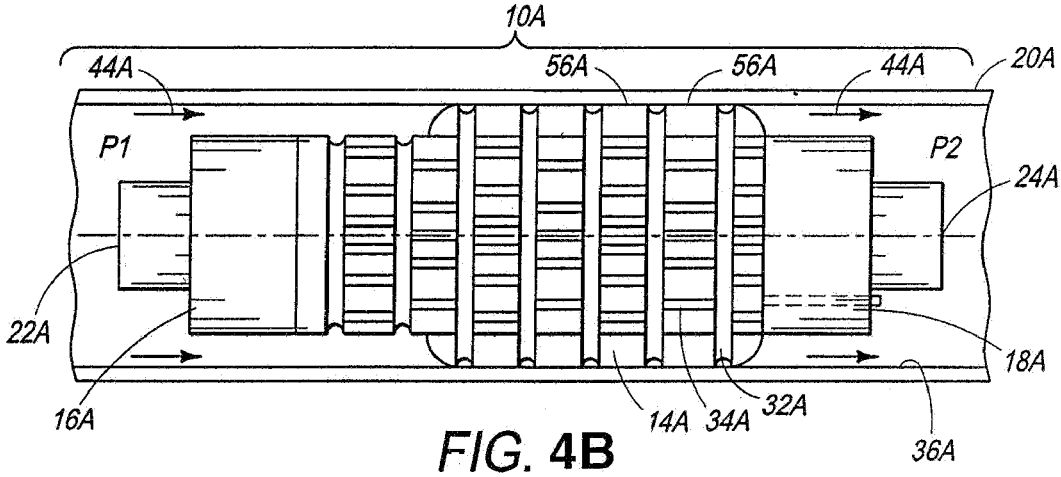
FIG. 4B is an enlarged schematic cross sectional view of the alternate embodiment flow control packer (FCP) controlling fluid flow in the conduit at a second inflation pressure.
Figure 4C:
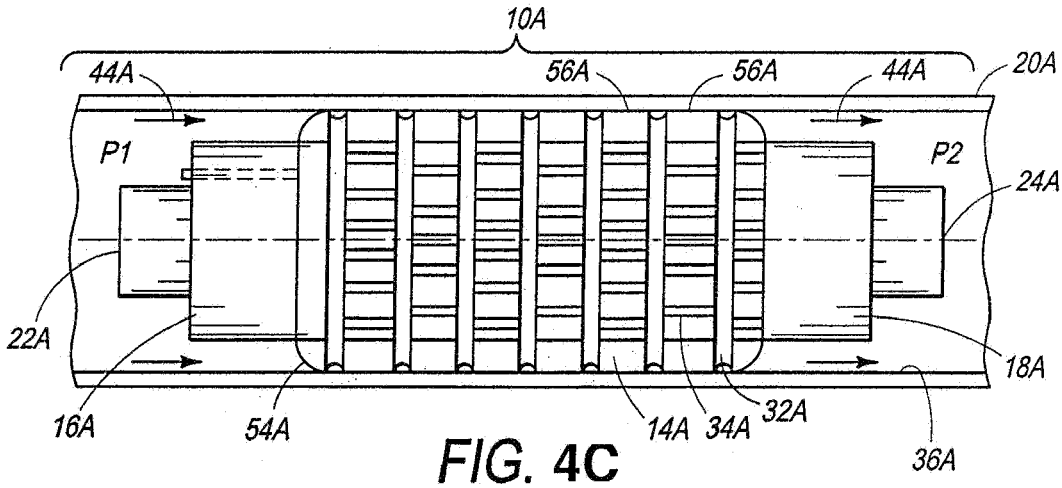
FIG. 4C is an enlarged schematic cross sectional view of the alternate embodiment flow control packer (FCP) shutting off fluid flow in the conduit at a third inflation pressure.

Referring to FIGS. 4A-4C, the operation of the flow control packer (FCP) 10A is illustrated. In FIG. 4A, the flow control packer (FCP) 10A has been placed in the conduit 20A to control fluid flow from left to right. As such, an upstream end of the conduit 20A has a fluid pressure P1, and a downstream end of the conduit 20 has a fluid pressure P2. In this case, P1 is greater than P2 (P1>P2). In addition, fluid flow through the conduit 20A is illustrated by fluid flow arrows 44A. In this example, the first end 22A (shut off end) is placed upstream, and the second end 24A (flow control end) of the flow control packer (FCP) 10A is placed downstream in the conduit 20A. In down hole applications, such as where the conduit 20A comprises a well casing or a borehole, the flow control packer (FCP) 10A in this orientation could be utilized to inject fluid in a downhole direction. However, the flow control packer (FCP) 10 could also be used to control fluid flow in an opposite direction in the conduit 20A (P2>P1), by placing the second end 24A (flow control end) upstream and the first end 22A (shut off end) downstream. In down hole applications with this alternate orientation, the flow control packer (FCP) 10A could be utilized to pump fluid in a uphole direction.

In FIG. 4A, the inflatable element 14A is inflated with an inflation pressure Pi having a value selected such that only flow control segments 56A of the inflatable element 14A proximate to the second end 24A (flow control end) of the flow control packer (FCP) 10A, press against the inside diameter 36A of the conduit 20A. In this case, the inflation pressure Pi can be selected to overcome the stretch pressure Ps of the inflatable element 14A near the second end 24A (flow control end), and the pressure P1 in the conduit as well. (Pi>Ps+P1). In addition, the inflation pressure Pi can be selected to achieve a selected downstream pressure P2, and a desired flow rate through the flow control channels 34A as well. To insure that the inflatable element 14A only inflates near the second end 24A (flow control end), the inflatable element 14A can be constructed with a lower stretch pressure near the second end 24A (flow control end) relative to the center and the first end 22A (shut off end).

In FIG. 4B, the inflatable element 14A is inflated with an inflation pressure Pi having a value selected such that more flow control segments 56A of the inflatable element 14A are in contact with the inside diameter 36A of the conduit 20A. This requires a higher inflation pressure Pi relative to the condition shown in FIG. 4A. In addition, as the flow control grooves 34A decrease in size in a direction away from the second end 24A (flow control end) towards the first end 22A (shut off end), the flow rate through the conduit 20A is less than the flow rate relative to the condition shown in FIG. 4A. The reduced flow rate also occurs due to higher flow restrictions and higher frictional head loss which are a function of the size of the flow control grooves. In the conduit 20A (FIGS. 4A-4C), the total head Th is equal to the velocity head Vh plus the pressure head Ph (Th=Vh+Ph). As the frictional losses increase with the smaller size of the flow control grooves 34A, the velocity head Vh, the pressure head Ph, and the total head Th decrease. By way of illustration and not limitation, the flow velocities in FIGS. 4A and 4B can be optimized to achieve a flow velocity through the flow control grooves 34A of from about 1 foot/second to 10 feet/second.

In FIG. 4C, the inflatable element 14A is inflated with an inflation pressure Pi having a value selected such that almost all of the inflatable element 14A is in contract with the inside diameter 36A of the conduit 20A. This requires a higher inflation pressure Pi relative to the condition shown in FIG. 4A or 4B. In addition, the flow rate through the conduit 20A can be effectively shut off as the inflatable element 14A has no flow control grooves 34 in the shut off segment 54A near it's first end 22A (shut off end). The flow control packer (FCP) 10A can thus be operated to control the flow rate, or to shut off the flow rate through the conduit 20A, as a function of the inflation pressure Pi of the inflatable element 14A.

Figure 5A:
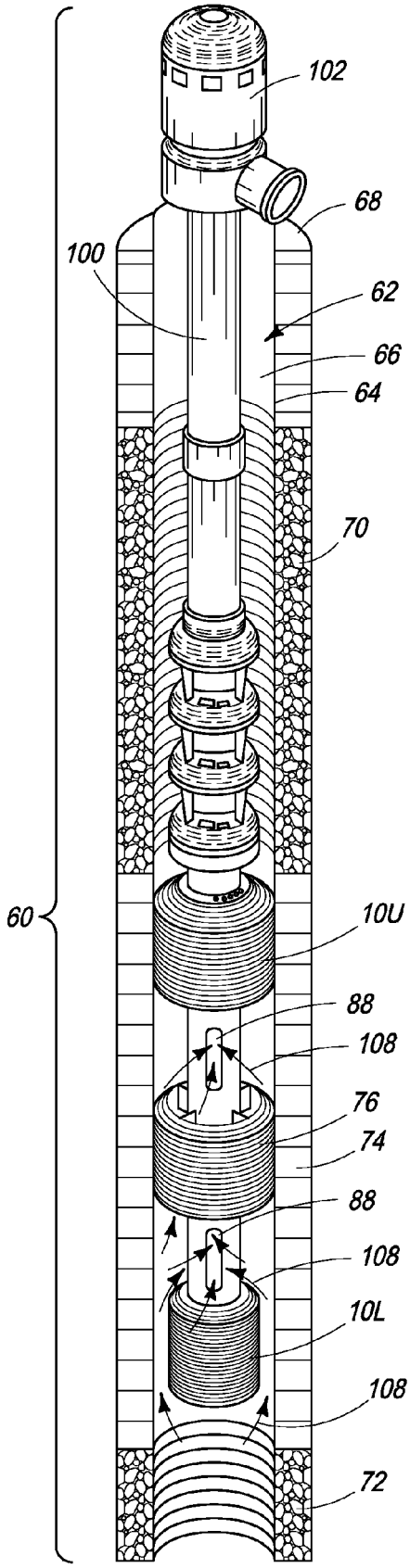
FIG. 5A is a schematic perspective view of a system for controlling fluid flow in a water well shown pumping water from a first (lower) section of the well.
Figure 5B:
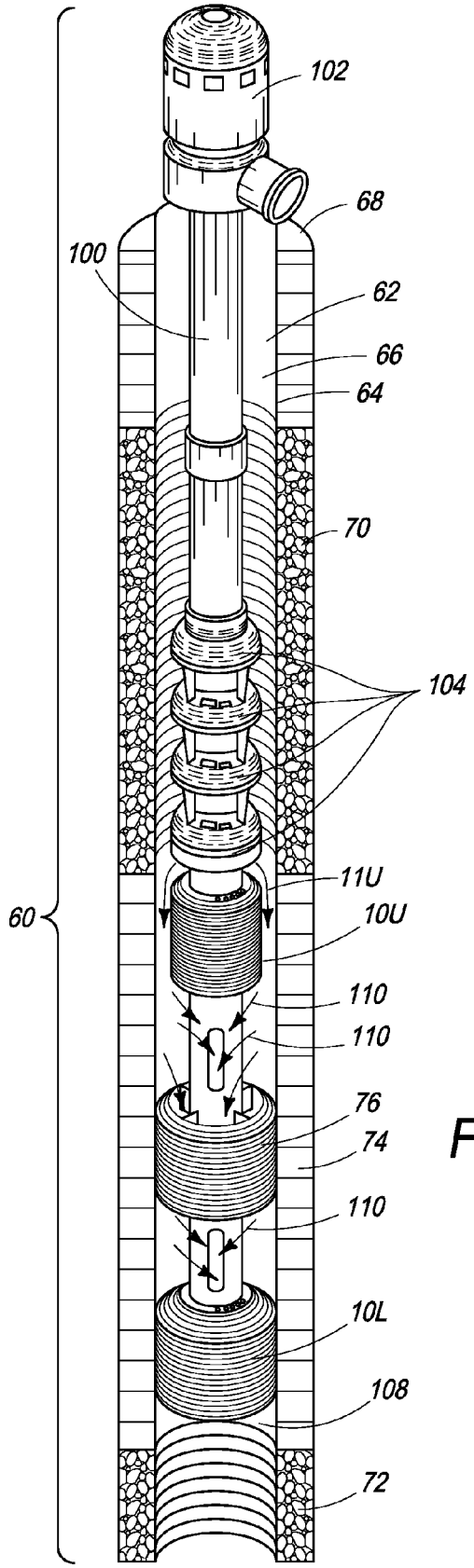
FIG. 5B is a schematic perspective view of the system shown pumping water from a second (upper) section of the well.

Referring to FIGS. 5A and 5B, a system 60 configured to pump water from a well 62 is illustrated. In the illustrative embodiment, the well 62 comprises an aquifer storage and recovery (ASR) well, and the fluid being controlled is water. However, the system 60 can be configured to control other types of wells, and other fluids, such as oil and gas. In addition, the system can be configured to control fluid flow in other piping systems including above ground systems. Further, the system 60 can be configured to inject water into the well 62 rather than pump water from the well 62.

The well 62 includes a cylindrical well casing 64 extending from a ground surface 68 into one or more geological formations at a required depth. This depth is typically from several hundred to several thousand feet. The well 62 also includes an upper water bearing zone 70, a lower water bearing zone 72 and a confining layer 74 between the water bearing zones 70, 72. The well casing 64 is perforated in the water bearing zones 70, 72 such that an inside diameter 66 of the well casing 64 is in flow communication with the water bearing zones 70, 72.

The system 60 includes a center conduit 100 in flow communication with a pump 102 at the surface. The system 60 also includes an array of vertical turbine bowls 104 on the outside of the center conduit 100. The system 60 also includes an upper flow control packer (FCP) 10U, a lower flow control packer (FCP) 10L, and a stabilizing packer 76 between the flow control packers (FCP) 10U, 10L. The flow control packers (FCP) 10U, 10L are substantially similar to the previously described flow control packer 10A (FIG. 3). In addition, the stabilizing packer 76 is an optional additional element configured to stabilize the flow control packers 10U, 10L (FCP) in the well 62.

Figure 6A:
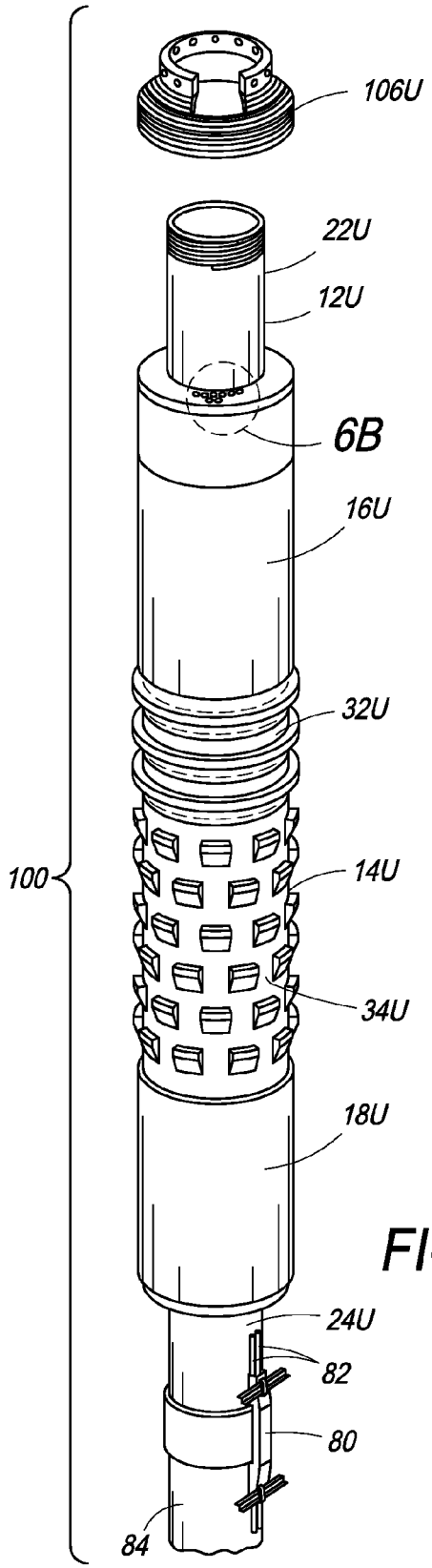
FIG. 6A is an enlarged schematic perspective view of an upper flow control packer (FCP) of the system of FIGS. 5A and 5B.

As shown in FIG. 6A, the upper flow control packer (FCP) 10U includes a packer mandrel 12U, an inflatable element 14U, and attachment members 16U, 18U constructed substantially as previously described. The upper flow control packer (FCP) 10U can also include a removable bell diverter 106U, or dome, configured to streamline flow around the upper surface of the upper flow control packer (FCP) 10U.

As shown in FIG. 6A, the inflatable element 14U includes circumferential grooves 32U and flow control grooves 34U constructed substantially as previously described. In addition, the upper flow control packer (FCP) 10U is oriented in the well casing 64 with it's first end 22U (shut off end) located above, or uphole from its' second end 24U (flow control end). In addition, couplings 80 are provided for attaching the packer mandrel 12U of the upper flow control packer (FCP) 10U to the packer mandrel 84 of the stabilizing packer 76. The conduits 82 can be attached to the couplings 80 for transmitting inflation fluids between the upper flow control packer (FCP) 10U, the stabilizing packer 76 and the lower flow control packer (FCP) 10L.

Figure 6B:
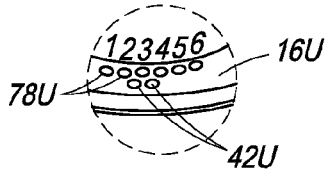
FIG. 6B is an enlarged schematic perspective view taken along line 6B of FIG. 6A.

As shown in FIG. 6B, the upper flow control packer (FCP) 10U includes inflation ports 42U and pass through ports 78U. The inflation ports 42U allow the conduits 82 to pass through the upper flow control packer (FCP) 10U for transmitting a fluid (gas or liquid) for inflating the inflatable element 14U substantially as previously described. The pass through ports 78U also allow the conduits 82 to pass through the upper flow control packer (FCP) 10U for transmitting a fluid (gas or liquid) for inflating the stabilizing packer 76 and the lower flow control packer (FCP) 10L.

Figure 6C:
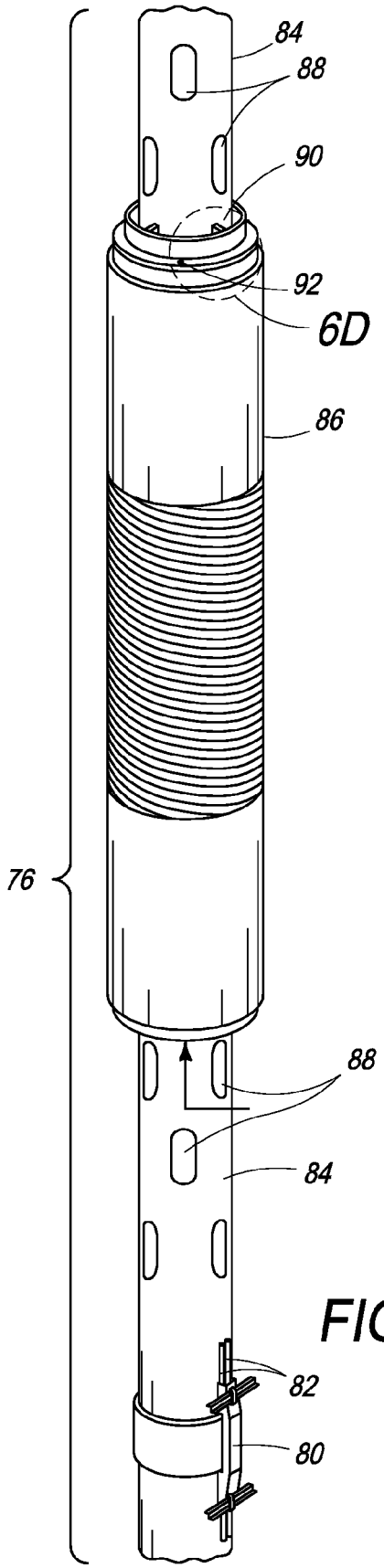
FIG. 6C is an enlarged schematic perspective view of a middle stabilizing packer of the system of FIGS. 5A and 5B.
Figure 6D:
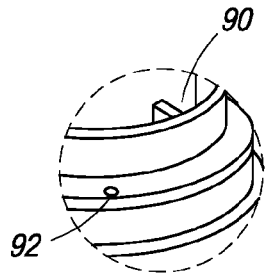
FIG. 6D is an enlarged schematic perspective view taken along line 6D of FIG. 6C.

As shown in FIG. 6C, the stabilizing packer 76 includes a packer mandrel 84 and an inflatable element 86. The stabilizing packer 76 is a conventional fixed end inflatable packer having the inflatable element 86 configured for inflation to sealingly engage the inside diameter 66 of the well casing 64. As such, the inflatable element 86 does not include circumferential grooves or flow control grooves. However, the stabilizing packer 76 includes openings 88 in the packer mandrel 84 which allow fluid flow into the inside of the packer mandrel 84 when the inflatable element 86 is inflated to sealingly engage the inside diameter 66 of the well casing 64. The stabilizing packer 76 also includes a finned pass through area 90 (FIG. 6D) which allows fluid flow through the stabilizing packer 76, and a bleed port 92 (FIG. 6D) for deflating the inflatable element 86.

Figure 6E:
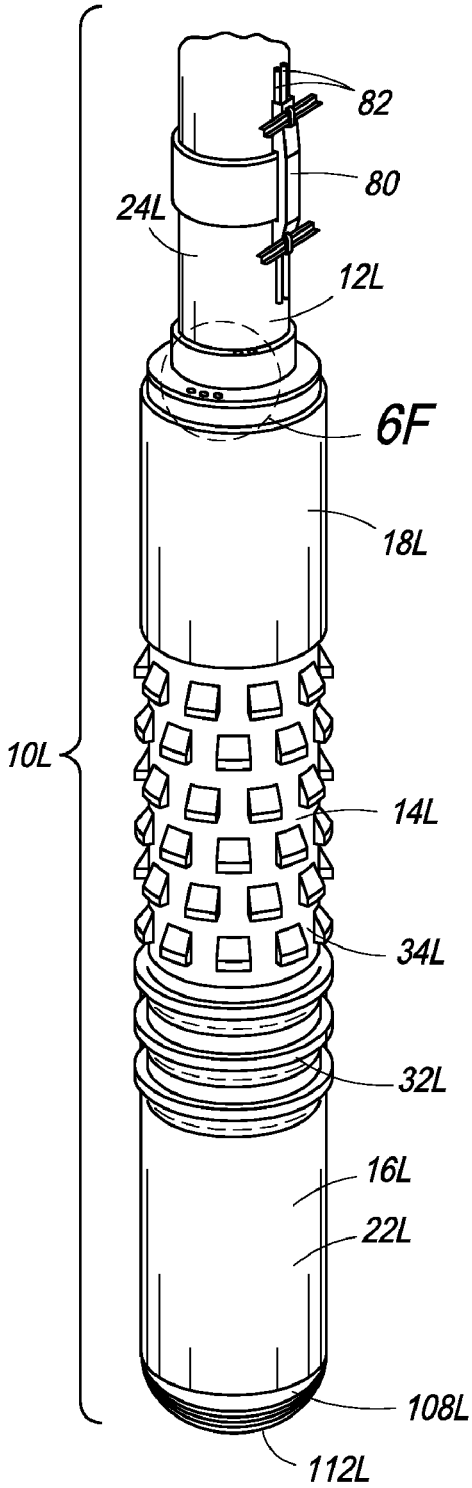
FIG. 6E is an enlarged schematic perspective view of a lower flow control packer (FCP) of the system of FIGS. 5A and 5B.
Figure 6F:
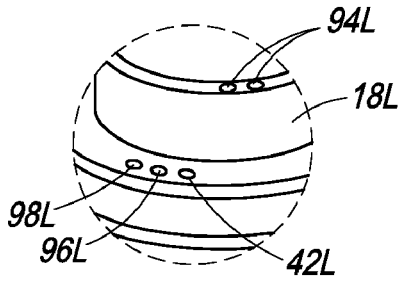
FIG. 6F is an enlarged schematic perspective view taken along line 6D of FIG. 6C.

As shown in FIG. 6E, the lower flow control packer (FCP) 10L includes a packer mandrel 12L, an inflatable element 14L, and attachment members 16L, 18L constructed substantially as previously described. The inflatable element 14L includes circumferential grooves 32L and flow control grooves 34L constructed substantially as previously described. In addition, the lower flow control packer (FCP) 10L is oriented in the well casing 64 with it's second end 24L (flow control end) located above or uphole from it's first end 22U (shut off end). As shown in FIG. 6F, the lower flow control packer (FCP) 10L includes an inflation port 42L for a conduit 82 for transmitting a fluid (gas or liquid) for inflating the inflatable element 14L substantially as previously described. The lower flow control packer (FCP) 10L also includes additional ports for conduits 82 including inflation ports 94L to the stabilizing packer 76L, a level or inflate port 96L, and an air tube port 98L. In addition, the lower flow control packer (FCP) 10L can include a bell diverter 106L having drain holes 112L which allow water to drain when the system 60 is pulled from the well 62.

Referring to FIGS. 5A and 5B, the operation of the system 60 is illustrated. In FIG. 5A, water is pumped from the lower water bearing zone 72 to the surface 68. To perform this function, the upper flow control packer (FCP) 10U is inflated to a pressure selected to achieve a shut off condition. In addition, the lower flow control packer (FCP) 10L is inflated to a pressure selected to achieve a desired flow rate through the annular grooves 32L (FIG. 6E) and the flow control grooves 34L (FIG. 6E) of the lower flow control packer (FCP) 10L. In this configuration of the system 60, water can flow from the lower water bearing zone 72 into the well casing 64, and between the lower flow control packer (FCP) 10L and the inside diameter 66 of the well casing 64. In addition, water can flow into the openings 88 of the stabilizing packer 76 and through the stabilizing packer 76, into the inside diameter of the center conduit 100, and upward through the center conduit 100 to the surface 68. Flow arrows 108 indicate the flow direction of the water from the lower water bearing zone 72, through the lower flow control packer (FCP) 10L, through the stabilizing packer 76, and through the center conduit 100 to the surface 68.

In FIG. 5B water is pumped from the upper water bearing zone 70 to the surface 68. To perform this function the lower flow control packer (FCP) 10L is inflated to a pressure selected to achieve a shut off condition. In addition, the upper flow control packer (FCP) 10U is inflated to a pressure selected to achieve a desired flow rate through the annular grooves 32U (FIG. 6A) and the flow control grooves 34U (FIG. 6A) of the upper flow control packer (FCP) 10U. In this configuration of the system 60 water can flow from the upper water bearing zone 70 into the well casing 64, and between the upper flow control packer (FCP) 10U and the inside diameter 66 of the well casing 64. In addition, water can flow into the openings 88 of the stabilizing packer 76 and through the stabilizing packer 76, into the inside diameter of the center conduit 100, and upward through the center conduit 100 to the surface 68. Flow arrows 110 indicate the flow direction of the water from the upper water bearing zone 70, through the upper flow control packer (FCP) 10U, through the stabilizing packer 76, and through the center conduit 100 to the surface 68.

While a number of exemplary aspects and embodiments have been discussed above, those of skill in the art will recognize certain modifications, permutations, additions and subcombinations thereof. It is therefore intended that the following appended claims and claims hereafter introduced are interpreted to include all such modifications, permutations, additions and sub-combinations as are within their true spirit and scope.

What is claimed is:

1. A packer for controlling fluid flow in a conduit comprising:

a packer mandrel; and an inflatable element fixedly attached at each end to the packer mandrel configured for inflation with a selected inflation pressure, the inflatable element having a length, an outside surface and a variable stretch pressure along the length, the inflatable element comprising a plurality of spaced circumferential grooves on the outside surface, and a plurality of flow control grooves on the outside surface between the circumferential grooves, the circumferential grooves and the flow control grooves configured to provide flow channels for a fluid flow between the inflatable element and the conduit and to control a flow rate of the fluid flow as a function of the inflation pressure, the variable stretch pressure selected to control contact of the circumferential grooves with the conduit along the length as a function of the inflation pressure.

2. The packer of claim 1 wherein the flow control grooves vary in size along the length of the inflatable element and provide variable flow resistance along the length.

3. The packer of claim 1 wherein the inflatable element has a first end and a second end, the stretch pressure is lowest near the first end and the flow control grooves decrease in size from the first end to the second end.

4. The packer of claim 1 wherein the inflatable element has a medial axis through a center thereof, the stretch pressure is lowest near the medial axis, and the flow control grooves decrease in size from the medial axis towards opposing ends of the inflatable element.

5. The packer of claim 1 wherein the inflatable element comprises an elastomeric base material reinforced with cord.

6. The packer of claim 1 further comprising attachment members at either end of the inflatable element for attaching the inflatable element to the packer mandrel.

7. The packer of claim 1 wherein the inflatable element has a shut off segment with no flow control grooves and the stretch pressure to inflate the shut off segment is higher than the stretch pressure to inflate segments of the inflatable elements containing the flow control grooves.

8. A packer for controlling fluid flow in a conduit comprising:

a packer mandrel; and an inflatable element fixedly attached at each end to the packer mandrel comprising a plurality of spaced circumferential grooves on an outside surface thereof separating the inflatable element into a plurality of separate segments, the segments including a plurality of flow control segments each having a plurality of flow control grooves on the outside surface configured to allow fluid flow between the inflatable element and the conduit at selected inflation pressures, and at least one shut off segment without the flow control grooves configured to shut off fluid flow through the conduit at a selected inflation pressure, the circumferential grooves and the flow control grooves configured to provide flow channels for the fluid flow between the inflatable element and the conduit and to control a flow rate of the fluid flow as a function of the inflation pressure.

9. The packer of claim 8 wherein a size of the flow control grooves varies on different flow control segments.

10. The packer of claim 8 wherein a stretch pressure of the flow control segments is different for each segment.

11. A packer for controlling fluid flow in a conduit comprising:

a packer mandrel; and an inflatable element attached to the packer mandrel configured for inflation in the conduit with a selected inflation pressure, the inflatable element having a first segment configured to inflate with a first inflation pressure and a second segment configured to inflate with a second inflation pressure higher than the first inflation pressure, the inflatable element comprising a plurality of circumferential grooves and a plurality of flow control grooves on the first segment, the circumferential grooves and the flow control grooves configured to provide flow channels for a fluid flow between the inflatable element and the conduit and to control a flow rate of the fluid flow as a function of inflation pressure with inflation to the first inflation pressure, the second segment configured to shut off fluid flow between the inflatable element and the conduit with inflation to the second inflation pressure.

12. The packer of claim 11 wherein the first segment is near a middle portion of the inflatable element and the second segment is near an end portion of the inflatable element.

13. The packer of claim 11 wherein the first segment is near a first end of the inflatable element and the second segment is near a second end of the inflatable element.

14. The packer of claim 11 wherein the inflatable element comprises a plurality of segments containing the flow control grooves separated by a plurality of circumferential grooves.

15. A packer for controlling fluid flow in a conduit comprising:

a packer mandrel; and an inflatable element attached to the packer mandrel having a first end, a second end, a medial axis, and a variable stretch pressure which is highest near the medial axis and lowest near the first end and the second end, the inflatable element comprising a plurality of spaced circumferential grooves on the outside surface, and a plurality of flow control grooves on the outside surface between the circumferential grooves configured to control fluid flow between the inflatable element and the conduit and a flow rate of the fluid flow as a function of the inflation pressure, the flow control grooves decreasing in size from the medial axis towards the first end and the second end, the variable stretch pressure selected to control contact of the circumferential grooves with the conduit along the length as a function of the inflation pressure.

16. The packer of claim 15 wherein the inflatable element has a segment near the first end without flow control grooves which is configured to shut off fluid flow in a first direction through the conduit.

17. The packer of claim 15 wherein the inflatable element has a segment near the second end without flow control grooves which is configured to shut off fluid flow in a second direction through the conduit.

18. A packer for controlling fluid flow in a conduit comprising:

a packer mandrel; and an inflatable element attached to the packer mandrel having a first end, a second end, and a variable stretch pressure which is highest near the first end and lowest near the second end, the inflatable element comprising a plurality of spaced circumferential grooves on the outside surface, and a plurality of flow control grooves on the outside surface between the circumferential grooves configured to control fluid flow between the inflatable element and the conduit and a flow rate of the fluid flow as a function of the inflation pressure, the flow control grooves decreasing in size from the second end towards the first end, the variable stretch pressure selected to control contact of the circumferential grooves with the conduit along the length as a function of the inflation pressure.

19. The packer of claim 18 wherein the inflatable element has a segment near the first end without flow control grooves which is configured to shut off fluid flow through the conduit.

20. A system comprising:

a conduit;

at least one flow control packer in the conduit comprising:

a packer mandrel; and an inflatable element fixedly attached at each end to the packer mandrel comprising a plurality of spaced circumferential grooves on an outside surface thereof separating the inflatable element into a plurality of separate segments, the segments including a plurality of flow control segments each having a plurality of flow control grooves on the outside surface configured to allow fluid flow between the inflatable element and the conduit at selected inflation pressures, and at least one shut off segment configured to shut off fluid flow through the conduit at a selected inflation pressure;

the circumferential grooves and the flow control grooves configured to provide flow channels for the fluid flow between the inflatable element and the conduit and to control a flow rate of the fluid flow as a function of the inflation pressure.

21. The system of claim 20 wherein the conduit comprises a well casing in flow communication with a first zone and a second zone, and the system further comprises a first flow control packer and a second flow control packer configured to control fluid flow from the first zone or the second zone as a function of a first inflation pressure in the first flow control packer and a second inflation pressure in the second flow control packer.

22. The system of claim 21 further comprising a central conduit and a pump in the well casing in flow communication with the first flow control packer and the second flow control packer.

23. The system of claim 22 further comprising a stabilizing packer between the first flow control packer and the second flow control packer having a packer mandrel in flow communication with the central conduit.

24. The system of claim 23 wherein the well comprises a water well.

25. The system of claim 24 wherein the well comprises an aquifer storage and recovery well.

* * * * *